US011112154B2

(12) United States Patent
Kumakura et al.

(10) Patent No.: US 11,112,154 B2
(45) Date of Patent: Sep. 7, 2021

(54) AIR CONDITIONER

(71) Applicant: Daikin Industries, LTD., Osaka (JP)

(72) Inventors: Eiji Kumakura, Osaka (JP); Ikuhiro Iwata, Osaka (JP); Tetsuya Okamoto, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 44 days.

(21) Appl. No.: 16/492,753

(22) PCT Filed: Mar. 23, 2018

(86) PCT No.: PCT/JP2018/011897
§ 371 (c)(1),
(2) Date: Sep. 10, 2019

(87) PCT Pub. No.: WO2018/181065
PCT Pub. Date: Oct. 4, 2018

(65) Prior Publication Data

US 2020/0072518 A1 Mar. 5, 2020

(30) Foreign Application Priority Data

Mar. 31, 2017 (JP) ..... JP2017-070186

(51) Int. Cl.
*F25B 49/02* (2006.01)
*F25B 13/00* (2006.01)

(52) U.S. Cl.
CPC ..... *F25B 49/02* (2013.01); *F25B 13/00* (2013.01)

(58) Field of Classification Search
CPC combination set(s) only.
See application file for complete search history.

(56) References Cited

U.S. PATENT DOCUMENTS 4,179,894 A * 12/1979 Hughes ..... F24D 11/0221 62/79
2006/0254294 A1* 11/2006 Shimamoto ..... F24F 3/065 62/238.7

(Continued)

FOREIGN PATENT DOCUMENTS

EP 3 128 248 * 2/2017
EP 3 128 248 A1 2/2017

(Continued)

OTHER PUBLICATIONS

Extended European Search Report dated Nov. 3, 2020 in corresponding European Application No. 18776250.5.

*Primary Examiner* — Henry T Crenshaw
(74) *Attorney, Agent, or Firm* — Birch, Stewart, Kolasch & Birch, LLP

(57) ABSTRACT

A control unit (19) that controls the operation of a refrigerant circuit (10) executes pump down operation in which a non-azeotropic refrigerant mixture is collected into a portion of the refrigerant circuit (10) within an outdoor unit (2), executes compositional ratio determination in which the compositional ratio of the non-azeotropic refrigerant mixture is determined based on the pressure and temperature of the non-azeotropic refrigerant mixture collected into the outdoor unit (2) by the pump down operation, and generates an alert when the compositional ratio of the non-azeotropic refrigerant mixture determined by the compositional ratio determination is outside an acceptable proportion range of a hydrofluorocarbon having the property of undergoing a disproportionation reaction.

7 Claims, 8 Drawing Sheets

(56) References Cited

U.S. PATENT DOCUMENTS

| | | | | |
|---|---|---|---|---|
| 2009/0145143 | A1* | 6/2009 | McMasters | F25B 45/00 62/149 |
| 2013/0126431 | A1* | 5/2013 | Henson | C02F 9/00 210/638 |
| 2014/0070132 | A1 | 3/2014 | Fukushima | |
| 2014/0331702 | A1* | 11/2014 | Tanaka | F25B 41/043 62/159 |
| 2016/0327321 | A1* | 11/2016 | Sugimoto | F25B 41/06 |
| 2017/0003060 | A1* | 1/2017 | Tanaka | F25B 13/00 |
| 2018/0017298 | A1* | 1/2018 | Dziubinschi | F25B 43/006 |
| 2018/0283994 | A1* | 10/2018 | Woo | F16J 3/06 |

FOREIGN PATENT DOCUMENTS

| | | | |
|---|---|---|---|
| WO | WO 2012/157764 | A1 | 11/2012 |
| WO | WO 2015/140874 | A1 | 9/2015 |
| WO | WO 2015/140883 | A1 | 9/2015 |

* cited by examiner

AIR CONDITIONER

TECHNICAL FIELD

The present invention relates to air conditioners.

BACKGROUND ART

Refrigerants such as HFC-32 (difluoromethane), HFC-410A, which is a mixture of HFC-32 and HFC-125 (pentafluoroethane), and HFC-134a (1,1,1,2-tetrafluoroethane) are conventionally used as refrigerants sealed in the refrigerant circuits of air conditioners to prevent the destruction of the ozone layer. However, these refrigerants have a problem in that they have high global warming potentials (GWPs).

In contrast, as disclosed in PTL 1 (International Publication No. 2012/157764), HFO-1123 (1,1,2-trifluoroethylene) is known to have less effect on the ozone layer and global warming. PTL 1 discloses that a mixture of HFO-1123 with another refrigerant such as HFC-32 is sealed into a refrigerant circuit to constitute an air conditioner.

SUMMARY OF THE INVENTION

HFO-1123 has the property of undergoing a disproportionation reaction (self-decomposition reaction) when given some energy under high-pressure and high-temperature conditions. A disproportionation reaction of HFO-1123 in a refrigerant circuit results in a rapid pressure and temperature rise. This may damage the devices and pipes that constitute the refrigerant circuit and may thus cause the refrigerant and its reaction products to be released out of the refrigerant circuit. Thus, when a hydrofluorocarbon having the property of undergoing a disproportionation reaction is sealed as a refrigerant into a refrigerant circuit to constitute an air conditioner, it is necessary to reduce the likelihood of the refrigerant undergoing a disproportionation reaction. As a countermeasure, if a mixture of a hydrofluorocarbon having the property of undergoing a disproportionation reaction with another refrigerant is used, the proportion of the hydrofluorocarbon having the property of undergoing a disproportionation reaction in the refrigerant mixture can be reduced, thereby reducing the likelihood of the refrigerant undergoing a disproportionation reaction.

However, if a refrigerant mixed with the hydrofluorocarbon having the property of undergoing a disproportionation reaction has a different boiling point from that of the hydrofluorocarbon having the property of undergoing a disproportionation reaction, the mixture of the hydrofluorocarbon having the property of undergoing a disproportionation reaction with the other refrigerant is a non-azeotropic refrigerant mixture of a low-boiling-point refrigerant and a high-boiling-point refrigerant. Thus, in an air conditioner that uses a non-azeotropic refrigerant mixture, a portion with a composition rich in a low-boiling-point refrigerant and a portion with a composition rich in a high-boiling-point refrigerant occur in the refrigerant circuit due to the circulation of the non-azeotropic refrigerant mixture that involves heat release and evaporation during air conditioning operation such as cooling operation or heating operation. This results in an uneven distribution of the hydrofluorocarbon having the property of undergoing a disproportionation reaction in the various portions of the refrigerant circuit. If the non-azeotropic refrigerant mixture leaks in this state, the proportion of the hydrofluorocarbon having the property of undergoing a disproportionation reaction in the non-azeotropic refrigerant mixture in the refrigerant circuit may increase to an extent that would not happen without the leakage of the non-azeotropic refrigerant mixture. This may result in a disproportionation reaction. Also, if the non-azeotropic refrigerant mixture sealed in the refrigerant circuit does not have the desired compositional ratio because of poor charge, the proportion of the hydrofluorocarbon having the property of undergoing a disproportionation reaction in the non-azeotropic refrigerant mixture in the refrigerant circuit may increase to an extent that would not happen when the refrigerant circuit were charged with the non-azeotropic refrigerant mixture having the desired compositional ratio. This may result in a disproportionation reaction.

An object of the present invention is to reduce, in an air conditioner including a refrigerant circuit having sealed therein a non-azeotropic refrigerant mixture containing a hydrofluorocarbon having the property of undergoing a disproportionation reaction, the likelihood of the refrigerant undergoing a disproportionation reaction even when the leakage or poor charge of the non-azeotropic refrigerant mixture occurs.

An air conditioner according to a first aspect includes a refrigerant circuit including an outdoor unit and an indoor unit that are connected together and a control unit that controls the operation of the refrigerant circuit. A non-azeotropic refrigerant mixture containing a hydrofluorocarbon having the property of undergoing a disproportionation reaction is sealed in the refrigerant circuit. The control unit executes pump down operation in which the non-azeotropic refrigerant mixture is collected into a portion of the refrigerant circuit within the outdoor unit. The control unit executes compositional ratio determination in which the compositional ratio of the non-azeotropic refrigerant mixture is determined based on the pressure and temperature of the non-azeotropic refrigerant mixture collected into the outdoor unit by the pump down operation. The control unit generates an alert when the compositional ratio of the non-azeotropic refrigerant mixture determined by the compositional ratio determination is outside an acceptable proportion range of the hydrofluorocarbon having the property of undergoing a disproportionation reaction.

Here, as described above, the non-azeotropic refrigerant mixture is first collected into the outdoor unit by the pump down operation. Here, the pump down operation is an operation in which the refrigerant flows from the indoor unit to the outdoor unit while being stopped from flowing from the outdoor unit to the indoor unit. By the pump down operation, almost all of the non-azeotropic refrigerant mixture containing the hydrofluorocarbon having the property of undergoing a disproportionation reaction, which is unevenly distributed in the individual portions of the refrigerant circuit, can be collected into the outdoor unit to create a state suitable for the subsequent compositional ratio determination. Next, as described above, the compositional ratio determination is performed. In the compositional ratio determination, the compositional ratio of the non-azeotropic refrigerant mixture is determined based on the pressure and temperature of the non-azeotropic refrigerant mixture collected into the outdoor unit by the pump down operation. Here, a relation formula or data table of saturation pressure and saturation temperature for each compositional ratio of the non-azeotropic refrigerant mixture is prepared in advance, and in the compositional ratio determination, the compositional ratio of the non-azeotropic refrigerant mixture is determined from the pressure and temperature of the non-azeotropic refrigerant mixture collected into the outdoor unit. As described above, if the compositional ratio of the non-azeotropic refrigerant mixture determined by the compositional ratio determination is outside the acceptable proportion range of the hydrofluorocarbon having the property of undergoing a disproportionation reaction, it is determined that the refrigerant may undergo a disproportionation reaction and an alert can be generated and the operation of the air conditioner can be stopped. Here, the alert may be displayed on the air conditioner or. If the air conditioner is connected via a network to a service center or other site, the alert may be sent to the service center or other site. Otherwise, if the compositional ratio of the non-azeotropic refrigerant mixture determined by the compositional ratio determination is within the acceptable proportion range of the hydrofluorocarbon having the property of undergoing a disproportionation reaction, it is determined that the refrigerant will not undergo a disproportionation reaction and the operation of the air conditioner can be continued. Thus, here, it can be checked whether the proportion of the hydrofluorocarbon having the property of undergoing a disproportionation reaction in the non-azeotropic refrigerant mixture is outside the acceptable range because of the leakage or poor charge of the non-azeotropic refrigerant mixture.

Thus, here, in the air conditioner including the refrigerant circuit having sealed therein the non-azeotropic refrigerant mixture containing the hydrofluorocarbon having the property of undergoing a disproportionation reaction, the likelihood of the refrigerant undergoing a disproportionation reaction can be reduced even when the leakage or poor charge of the non-azeotropic refrigerant mixture occurs.

An air conditioner according to a second aspect is the air conditioner according to the first aspect, in which the control unit executes the pump down operation and the compositional ratio determination regularly.

Here, as described above, the pump down operation and the compositional ratio determination are performed regularly. Thus, the reliability against disproportionation reactions can be improved.

An air conditioner according to a third aspect is the air conditioner according to the first or second aspect, in which the outdoor unit includes a compressor, an outdoor heat exchanger, and a receiver. In the pump down operation, the non-azeotropic refrigerant mixture is collected into the outdoor heat exchanger and the receiver.

Here, as described above, the pump down operation is an operation in which the non-azeotropic refrigerant mixture is collected into the outdoor heat exchanger and the receiver. The pump down operation allows a large amount of non-azeotropic refrigerant mixture to be collected in a high-pressure liquid state. Thus, the accuracy of the compositional ratio determination can be improved.

An air conditioner according to a fourth aspect is the air conditioner according to the third aspect, in which in the compositional ratio determination, the compositional ratio of the non-azeotropic refrigerant mixture is determined based on the pressure of the non-azeotropic refrigerant mixture on the discharge side of the compressor and the temperature of the non-azeotropic refrigerant mixture in the outdoor heat exchanger or the receiver.

Here, the non-azeotropic refrigerant mixture is collected in a high-pressure saturated liquid state by the pump down operation; therefore, the saturation pressure and saturation temperature of the non-azeotropic refrigerant mixture are close to the pressure of the non-azeotropic refrigerant mixture on the discharge side of the compressor and the temperature of the non-azeotropic refrigerant mixture in the outdoor heat exchanger or the receiver, respectively. Thus, here, as described above, the compositional ratio of the non-azeotropic refrigerant mixture can be accurately determined based on the pressure of the non-azeotropic refrigerant mixture on the discharge side of the compressor and the temperature of the non-azeotropic refrigerant mixture in the outdoor heat exchanger or the receiver.

An air conditioner according to a fifth aspect is the air conditioner according to the third or fourth aspect, in which the receiver has a sampling port for extracting the non-azeotropic refrigerant mixture.

Here, as described above, the receiver has the sampling port for extracting the non-azeotropic refrigerant mixture. Thus, a detailed analysis of the compositional ratio of the non-azeotropic refrigerant mixture can be performed as necessary.

An air conditioner according to a sixth aspect is the air conditioner according to any one of the first to fifth aspects, in which the non-azeotropic refrigerant mixture contains HFO-1123.

HFO-1123, which is a type of hydrofluorocarbon having the property of undergoing a disproportionation reaction, has a lower boiling point than other refrigerants such as HFC-32. Therefore, when a non-azeotropic refrigerant mixture containing HFO-1123 is used, HFO-1123 acts as a low-boiling-point refrigerant and is unevenly distributed in the various portions of the refrigerant circuit.

However, here, by the pump down operation, almost all of the non-azeotropic refrigerant mixture containing HFO-1123, which is unevenly distributed in the various portions of the refrigerant circuit, can be collected into the outdoor unit, and by the compositional ratio determination, the compositional ratio of the non-azeotropic refrigerant mixture containing HFO-1123 can be determined.

Thus, here, in the air conditioner including the refrigerant circuit having sealed therein the non-azeotropic refrigerant mixture containing HFO-1123 as a hydrofluorocarbon having the property of undergoing a disproportionation reaction, the likelihood of the refrigerant undergoing a disproportionation reaction can be reduced even when the leakage or poor charge of the non-azeotropic refrigerant mixture occurs.

DESCRIPTION OF EMBODIMENTS

An embodiment of an air conditioner according to the present invention will hereinafter be described with reference to the drawings. The specific configuration of the embodiment of the air conditioner according to the present invention is not limited to the following embodiment and modifications thereof, but can be modified without departing from the spirit of the present invention.

(1) Configuration

Figure 1:
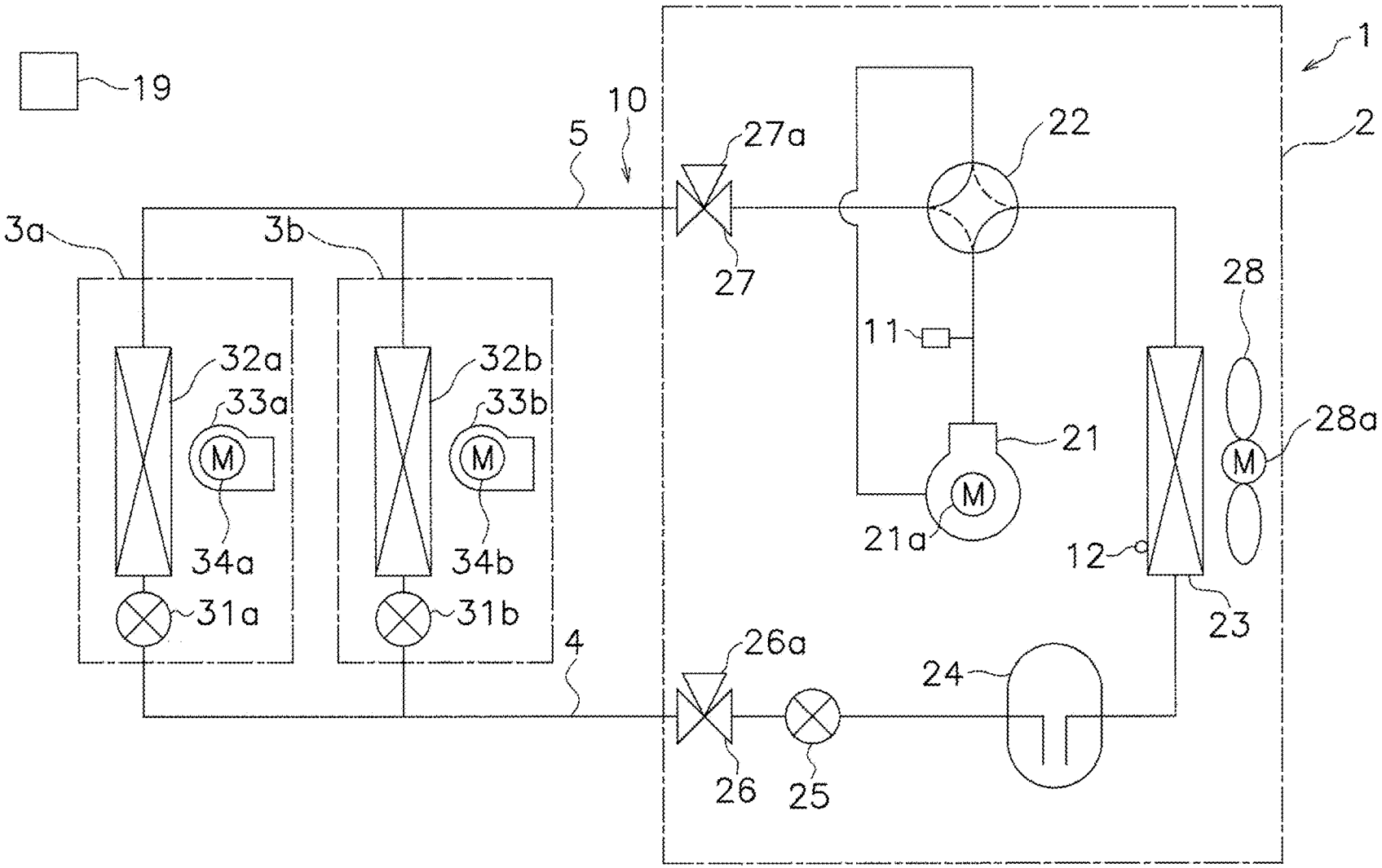
FIG. 1 is a schematic diagram of an air conditioner according to one embodiment of the present invention.

FIG. 1 is a schematic diagram of an air conditioner 1 according to one embodiment of the present invention.

<Overall Apparatus>

The air conditioner 1 is an apparatus capable of cooling and heating the indoor space of a building or other place through a vapor-compression refrigeration cycle. The air conditioner 1 mainly includes an outdoor unit 2, indoor units 3*a* and 3*b*, a liquid-refrigerant connection pipe 4 and a gas-refrigerant connection pipe 5 that connect the outdoor unit 2 and the indoor units 3*a* and 3*b* together, and a control unit 19 that controls the devices that constitute the outdoor unit 2 and the indoor units 3*a* and 3*b*. The outdoor unit 2 and the indoor units 3*a* and 3*b* are connected together via the refrigerant connection pipes 4 and 5 to constitute a vapor-compression refrigerant circuit 10 of the air conditioner 1.

<Indoor Unit>

The indoor units 3*a* and 3*b* are installed indoors or above a ceiling and constitute part of the refrigerant circuit 10. The indoor units 3*a* and 3*b* have the same configuration; here, only the configuration of the indoor unit 3*a* will be described. For the configuration of the indoor unit 3*b*, the suffix "a", which indicates the individual parts of the indoor unit 3*a*, is replaced with the suffix "b", and a description of the individual parts is omitted. The indoor unit 3*a* mainly includes an indoor expansion valve 31*a*, an indoor heat exchanger 32*a*, and an indoor fan 33*a*.

The indoor expansion valve 31*a* is an expansion mechanism that decompresses the refrigerant. Here, the indoor expansion valve 31*a* is an electric expansion valve.

The indoor heat exchanger 32*a* is a heat exchanger that exchanges heat between indoor air and the refrigerant flowing to or from the outdoor unit 2 through the liquid-refrigerant connection pipe 4 and the gas-refrigerant connection pipe 5. The liquid side of the indoor heat exchanger 32*a* is connected to the liquid-refrigerant connection pipe 4, whereas the gas side of the indoor heat exchanger 32*a* is connected to the gas-refrigerant connection pipe 5.

The indoor fan 33*a* is a fan that blows indoor air to the indoor heat exchanger 32*a*. The indoor fan 33*a* is driven by an indoor fan motor 34*a*.

<Outdoor Unit>

The outdoor unit 2 is installed outdoors and constitutes part of the refrigerant circuit 10. The outdoor unit 2 mainly includes a compressor 21, a four-way switching valve 22, an outdoor heat exchanger 23, a receiver 24, an outdoor expansion valve 25, a liquid-side shutoff valve 26, a gas-side shutoff valve 27, and an outdoor fan 28.

The compressor 21 is a device for compressing the refrigerant. For example, the compressor 21 is a compressor in which a positive-displacement compression element (not shown) is driven to rotate by a compressor motor 21*a*. The intake and discharge sides of the compressor 21 are connected to the four-way switching valve 22.

The four-way switching valve 22 is a switching mechanism capable of switching the flow of the refrigerant in the refrigerant circuit 10 such that the discharge side of the compressor 21 is connected to the gas side of the outdoor heat exchanger 23 (see the solid lines in the four-way switching valve 22 in FIG. 1) when the outdoor heat exchanger 23 functions as a radiator for the refrigerant (hereinafter referred to as "heat release state") and such that the intake side of the compressor 21 is connected to the gas side of the outdoor heat exchanger 23 (see the dashed lines in the four-way switching valve 22 in FIG. 1) when the outdoor heat exchanger 23 functions as an evaporator for the refrigerant (hereinafter referred to as "evaporation state").

The outdoor heat exchanger 23 is a heat exchanger that exchanges heat between outdoor air and the refrigerant flowing to or from the indoor unit 3 and the outdoor unit 2 through the liquid-refrigerant connection pipe 4 and the gas-refrigerant connection pipe 5. The liquid side of the outdoor heat exchanger 23 is connected to the receiver 24, whereas the gas side of the outdoor heat exchanger 23 is connected to the four-way switching valve 22.

The receiver 24 is a container for temporarily storing the refrigerant flowing to or from the indoor unit 3 through the liquid-refrigerant connection pipe 4. One end of the receiver 24 is connected to the liquid side of the outdoor heat exchanger 23, whereas the other end of the receiver 24 is connected to the outdoor expansion valve 25.

The outdoor expansion valve 25 is an expansion mechanism that decompresses the refrigerant. Here, the outdoor expansion valve 25 is an electric expansion valve. One end of the outdoor expansion valve 25 is connected to the receiver 24, whereas the other end of the outdoor expansion valve 25 is connected to the liquid-side shutoff valve 26.

The liquid-side shutoff valve 26 is a valve mechanism disposed at the connection between the outdoor unit 2 and the liquid-refrigerant connection pipe 4. Here, the liquid-side shutoff valve 26 is a manually operated valve with a service port 26*a* used for refrigerant charge and other purposes. One end of the liquid-side shutoff valve 26 is connected to the outdoor expansion valve 25, whereas the other end of the liquid-side shutoff valve 26 is connected to the liquid-refrigerant connection pipe 4. The gas-side shutoff valve 27 is a valve mechanism disposed at the connection between the outdoor unit 2 and the gas-refrigerant connection pipe 5. Here, the gas-side shutoff valve 27 is a manually operated valve with a service port 27*a* used for refrigerant charge and other purposes. One end of the gas-side shutoff valve 27 is connected to the four-way switching valve 22, whereas the other end of the gas-side shutoff valve 27 is connected to the gas-refrigerant connection pipe 5. The service ports 26*a* and 27*a* may be disposed anywhere in a portion of the refrigerant circuit 10 within the outdoor unit 2 and are not limited to those disposed on the shutoff valves 26 and 27.

The outdoor fan 28 is a fan that blows outdoor air to the outdoor heat exchanger 23. The outdoor fan 28 is driven by an outdoor fan motor 28*a*.

The outdoor unit 2 includes various sensors. Specifically, the outdoor unit 2 includes a discharge pressure sensor 11 that detects the pressure Pd of the refrigerant on the discharge side of the compressor 21. The outdoor unit 2 also includes an indoor heat-exchange temperature sensor 12 that detects the temperature Tl of the refrigerant in the outdoor heat exchanger 23.

<Refrigerant Connection Pipes>

The refrigerant connection pipes 4 and 5 are refrigerant pipes constructed on site when the air conditioner 1 is installed at an installation site in a building or other place. One end of the liquid-refrigerant connection pipe 4 is connected to the liquid-side shutoff valve 26 of the indoor unit 2, whereas the other end of the liquid-refrigerant connection pipe 5 is connected to the indoor expansion valves 31*a* and 31*b* of the indoor units 3*a* and 3*b*. One end of the gas-refrigerant connection pipe 5 is connected to the gas-side shutoff valve 27 of the indoor unit 2, whereas the other end of the gas-refrigerant connection pipe 5 is connected to the gas sides of the indoor heat exchangers 32*a* and 32*b* of the indoor units 3*a* and 3*b*.

<Control Unit>

The control unit 19 is composed of control boards disposed in the outdoor unit 2 and the indoor units 3*a* and 3*b* and other components such as remote controllers (not shown) that are connected in communication with each other. In FIG. 1, the control unit 19 is shown as being located apart from the outdoor unit 2 and the indoor units 3*a* and 3*b* for illustration purposes. The control unit 19 controls the devices 21, 22, 25, 31*a*, 31*b*, 33*a*, and 33*b* that constitute the air conditioner 1 (here, the outdoor unit 2 and the indoor units 3*a* and 3*b*). In other words, the control unit 19 controls the operation of the overall air conditioner 1, including the operation of the refrigerant circuit 10.

<Refrigerant Sealed in Refrigerant Circuit>

The refrigerant circuit 10 has sealed therein a refrigerant containing a hydrofluorocarbon having the property of undergoing a disproportionation reaction. Examples of such refrigerants include ethylenic hydrofluorocarbons (hydrofluoroolefins), which have less effect on both the ozone layer and global warming and have carbon-carbon double bonds which are readily decomposed by OH radicals. Here, among hydrofluoroolefins (HFOs), a refrigerant containing HFO-1123, which provides high performance, is used.

However, a disproportionation reaction of HFO-1123 in the refrigerant circuit results in a rapid pressure and temperature rise. This may damage the devices and pipes that constitute the refrigerant circuit 10 and may thus cause the refrigerant containing HFO-1123 and its reaction products to be released out of the refrigerant circuit 10.

Figure 2:
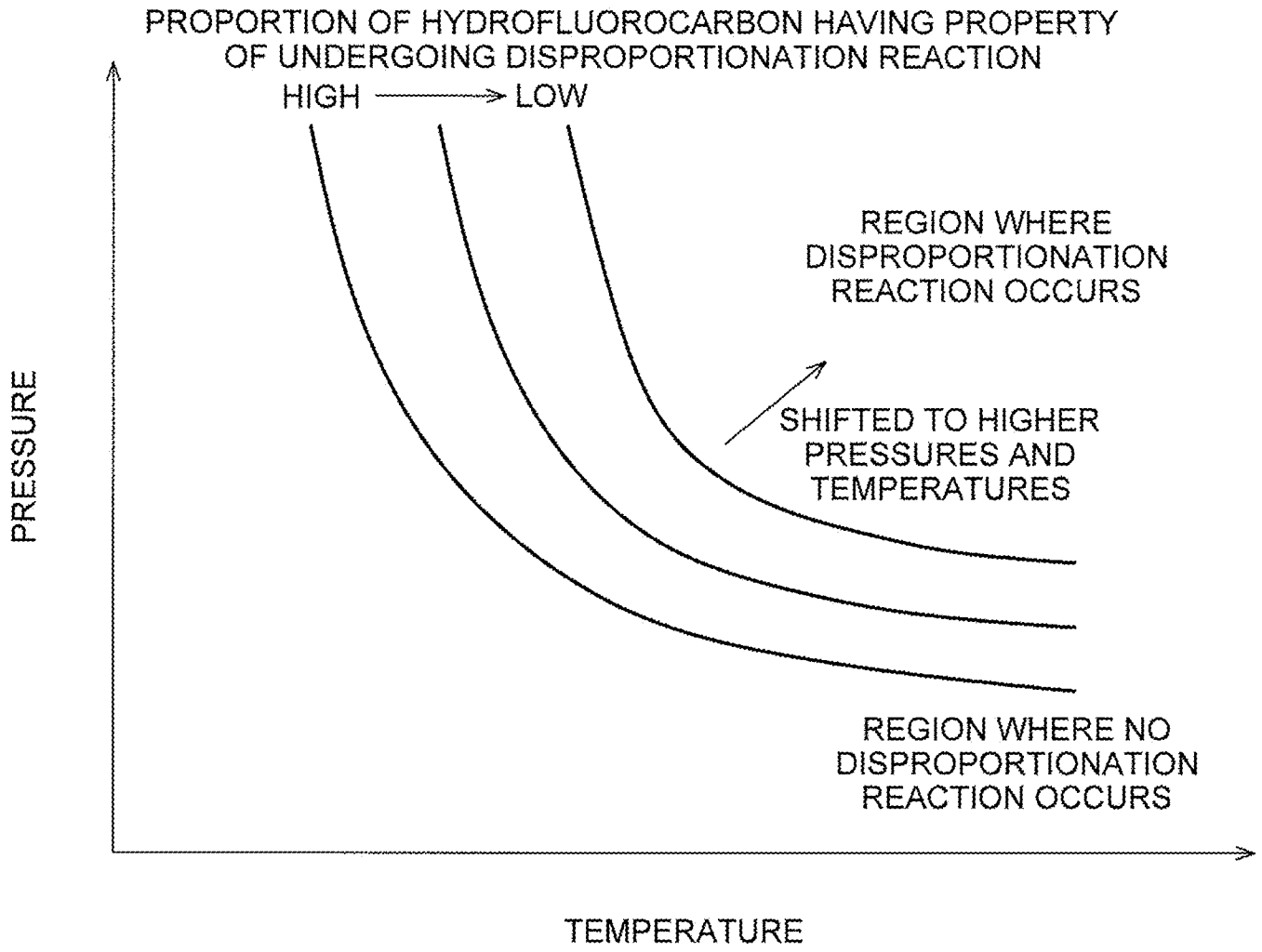
FIG. 2 is a graph showing the relationship between the pressure and temperature at which a refrigerant mixture containing a hydrofluorocarbon having the property of undergoing a disproportionation reaction undergoes a disproportionation reaction.

Thus, when the hydrofluorocarbon having the property of undergoing a disproportionation reaction, such as HFO-1123, is sealed as the refrigerant into the refrigerant circuit 10, it is necessary to reduce the likelihood of the refrigerant undergoing a disproportionation reaction. As a countermeasure, when a mixture of the hydrofluorocarbon having the property of undergoing a disproportionation reaction with another refrigerant is used, the proportion of the hydrofluorocarbon having the property of undergoing a disproportionation reaction in the refrigerant mixture can be reduced, thereby reducing the likelihood of the refrigerant undergoing a disproportionation reaction. Here, FIG. 2 is a graph showing the relationship between the pressure and temperature at which a refrigerant mixture containing a hydrofluorocarbon having the property of undergoing a disproportionation reaction undergoes a disproportionation reaction. The curves in FIG. 2 show the pressure and temperature limits at which the refrigerant mixture undergoes a disproportionation reaction. As the proportion of the hydrofluorocarbon having the property of undergoing a disproportionation reaction becomes lower, the curves are shifted to a region of higher pressures and temperatures (to the upper right of the graph). This graph indicates that the refrigerant undergoes a disproportionation reaction on the curves and in the regions above the curves and does not undergo a disproportionation reaction in the regions below the curves. That is, as discussed above, when a mixture of a hydrofluorocarbon having the property of undergoing a disproportionation reaction with another refrigerant (a refrigerant that does not have the property of undergoing a disproportionation reaction) is used to reduce the proportion of the hydrofluorocarbon having the property of undergoing a disproportionation reaction, the likelihood of the refrigerant undergoing a disproportionation reaction can be reduced. Here, the refrigerant containing HFO-1123 as a hydrofluorocarbon having the property of undergoing a disproportionation reaction is a mixture of HFO-1123 with another refrigerant. An example of a mixture of HFO-1123 with another refrigerant is a mixture of HFO-1123 with HFC-32. Here, HFO-1123 and HFC-32 are mixed in a ratio (wt %) of 40:60. Another example is a mixture of HFO-1123 with HFC-134a or HFO-1234yf (2,3,3,3-tetrafluoropropene). Here, HFO-1123 has a different boiling point from the other refrigerant (e.g., HFC-32); therefore, this refrigerant mixture is a non-azeotropic refrigerant mixture of a low-boiling-point refrigerant and a high-boiling-point refrigerant. In addition, HFO-1123 has a lower boiling point than the other refrigerant, such as HFC-32; therefore, this refrigerant mixture is a non-azeotropic refrigerant mixture containing HFO-1123 as a low-boiling-point refrigerant and the other refrigerant as a high-boiling-point refrigerant. The other refrigerant mixed with HFO-1123 is not limited to HFC-32 or other refrigerants, but may be any refrigerant that does not have the property of undergoing a disproportionation reaction. HFO-1123 need not be mixed with only one other refrigerant, but may be mixed with two or more other refrigerants. The hydrofluorocarbon having the property of undergoing a disproportionation reaction is not limited to HFO-1123, but may be an ethylenic or acetylenic hydrofluorocarbon having the property of undergoing a disproportionation reaction. In this case, the hydrofluorocarbon having the property of undergoing a disproportionation reaction may be a high-boiling-point refrigerant having a higher boiling point than the other refrigerant.

(2) Air Conditioning Operation

The air conditioner 1 performs cooling operation and heating operation as air conditioning operation. Air conditioning operation is executed by the control unit 19.

<Cooling Operation>

During cooling operation, the four-way switching valve 22 is switched to the heat release state (the state indicated by the solid lines in FIG. 1). In the refrigerant circuit 10, gaseous non-azeotropic refrigerant mixture at the low pressure of the refrigeration cycle is taken into the compressor 21, where the gaseous non-azeotropic refrigerant mixture is compressed to the high pressure of the refrigeration cycle before being discharged therefrom. The high-pressure gaseous non-azeotropic refrigerant mixture discharged from the compressor 21 passes through the four-way switching valve 22 and enters the outdoor heat exchanger 23. The high-pressure gaseous non-azeotropic refrigerant mixture entering the outdoor heat exchanger 23 releases heat in the outdoor heat exchanger 23, which functions as a radiator for the non-azeotropic refrigerant mixture, by heat exchange with outdoor air supplied as a cooling source by the outdoor fan 28, thus becoming high-pressure liquid non-azeotropic refrigerant mixture. The high-pressure liquid non-azeotropic refrigerant mixture that has released heat in the outdoor heat exchanger 23 is temporarily stored in the receiver 24 and then passes through the outdoor expansion valve 25, the liquid-side shutoff valve 26, and the liquid-refrigerant connection pipe 4 and enters the indoor expansion valves 31*a* and 31*b*. The non-azeotropic refrigerant mixture entering the indoor expansion valves 31*a* and 31*b* is decompressed by the indoor expansion valves 31*a* and 31*b* to the low pressure of the refrigeration cycle, thus becoming low-pressure gas-liquid two-phase non-azeotropic refrigerant mixture. The low-pressure gas-liquid two-phase non-azeotropic refrigerant mixture decompressed by the indoor expansion valves 31*a* and 31*b* enters the indoor heat exchangers 32*a* and 32*b*. The low-pressure gas-liquid two-phase non-azeotropic refrigerant mixture entering the indoor heat exchangers 32*a* and 32*b* evaporates in the indoor heat exchangers 32*a* and 32*b* by heat exchange with indoor air supplied as a heating source by the indoor fans 33*a* and 33*b*. In this way, the indoor air is cooled. The indoor air is then supplied to the indoor space to cool the indoor space. The low-pressure gaseous non-azeotropic refrigerant mixture evaporated in the indoor heat exchangers 32*a* and 32*b* passes through the gas-refrigerant connection pipe 5, the gas-side shutoff valve 27, and the four-way switching valve 22 and is taken into the compressor 21 again.

<Heating Operation>

During heating operation, the four-way switching valve 22 is switched to the evaporation state (the state indicated by the dashed lines in FIG. 1). In the refrigerant circuit 10, gaseous non-azeotropic refrigerant mixture at the low pressure of the refrigeration cycle is taken into the compressor 21, where the gaseous non-azeotropic refrigerant mixture is compressed to the high pressure of the refrigeration cycle before being discharged therefrom. The high-pressure gaseous non-azeotropic refrigerant mixture discharged from the compressor 8 passes through the four-way switching valve 22, the gas-side shutoff valve 27, and the gas-refrigerant connection pipe 5 and enters the indoor heat exchangers 32*a* and 32*b*. The high-pressure gaseous non-azeotropic refrigerant mixture entering the indoor heat exchangers 32*a* and 32*b* releases heat in the indoor heat exchangers 32*a* and 32*b* by heat exchange with indoor air supplied as a cooling source by the indoor fans 33*a* and 33*b*, thus becoming high-pressure liquid non-azeotropic refrigerant mixture. In this way, the indoor air is heated. The indoor air is then supplied to the indoor space to heat the indoor space. The high-pressure liquid non-azeotropic refrigerant mixture that has released heat in the indoor heat exchangers 32*a* and 32*b* passes through the indoor expansion valves 31*a* and 31*b*, the liquid-refrigerant connection pipe 4, and the liquid-side shutoff valve 26 and enters the outdoor expansion valve 25. The non-azeotropic refrigerant mixture entering the outdoor expansion valve 25 is decompressed by the outdoor expansion valve 25 to the low pressure of the refrigeration cycle, thus becoming low-pressure gas-liquid two-phase non-azeotropic refrigerant mixture. The low-pressure gas-liquid two-phase non-azeotropic refrigerant mixture decompressed by the outdoor expansion valve 25 is temporarily stored in the receiver 24 and then enters the outdoor heat exchanger 23. The low-pressure gas-liquid two-phase non-azeotropic refrigerant mixture entering the outdoor heat exchanger 23 evaporates in the outdoor heat exchanger 23, which functions as an evaporator for the non-azeotropic refrigerant mixture, by heat exchange with outdoor air supplied as a heating source by the outdoor fan 28, thus becoming low-pressure gaseous non-azeotropic refrigerant mixture. The low-pressure gaseous non-azeotropic refrigerant mixture evaporated in the outdoor heat exchanger 23 passes through the four-way switching valve 22 and is taken into the compressor 21 again.

(3) Measure Against Disproportionation Reaction of Refrigerant (Determination of Compositional Ratio of Non-Azeotropic Refrigerant Mixture)

In the air conditioner 1 including the refrigerant circuit 10 having sealed therein the non-azeotropic refrigerant mixture containing the hydrofluorocarbon having the property of undergoing a disproportionation reaction (here, HFO-1123), a portion with a composition rich in a low-boiling-point refrigerant (here, HFO-1123) and a portion with a composition rich in a high-boiling-point refrigerant (here, HFC-32 or other refrigerant) occur in the refrigerant circuit 10 due to the circulation of the non-azeotropic refrigerant mixture that involves heat release and evaporation during air conditioning operation such as cooling operation or heating operation. This results in an uneven distribution of the hydrofluorocarbon (here, HFO-1123, which is a low-boiling-point refrigerant) having the property of undergoing a disproportionation reaction in the various portions of the refrigerant circuit 10. If the non-azeotropic refrigerant mixture leaks in this state, the proportion of the hydrofluorocarbon having the property of undergoing a disproportionation reaction in the non-azeotropic refrigerant mixture in the refrigerant circuit 10 may increase to an extent that would not happen without the leakage of the non-azeotropic refrigerant mixture (see FIG. 2). This may result in a disproportionation reaction. Also, if the non-azeotropic refrigerant mixture sealed in the refrigerant circuit 10 does not have the desired compositional ratio because of poor charge, the proportion of the hydrofluorocarbon having the property of undergoing a disproportionation reaction in the non-azeotropic refrigerant mixture in the refrigerant circuit 10 may increase to an extent that would not happen when the refrigerant circuit 10 were charged with the non-azeotropic refrigerant mixture having the desired compositional ratio (see FIG. 2). This may result in a disproportionation reaction. Thus, it is necessary to reduce the likelihood of the refrigerant undergoing a disproportionation reaction even when the leakage or poor charge of the non-azeotropic refrigerant mixture occurs.

Accordingly, here, as described below, pump down operation, in which the non-azeotropic refrigerant mixture is collected into a portion of the refrigerant circuit 10 within the outdoor unit 2, is executed, compositional ratio determination, in which the compositional ratio of the non-azeotropic refrigerant mixture is determined based on the pressure and temperature of the non-azeotropic refrigerant mixture collected into the outdoor unit 2, is executed, and an alert is then generated when the compositional ratio of the non-azeotropic refrigerant mixture is outside an acceptable proportion range of the hydrofluorocarbon having the property of undergoing a disproportionation reaction.

<Pump Down Operation and Compositional Ratio Determination>

Figure 3:
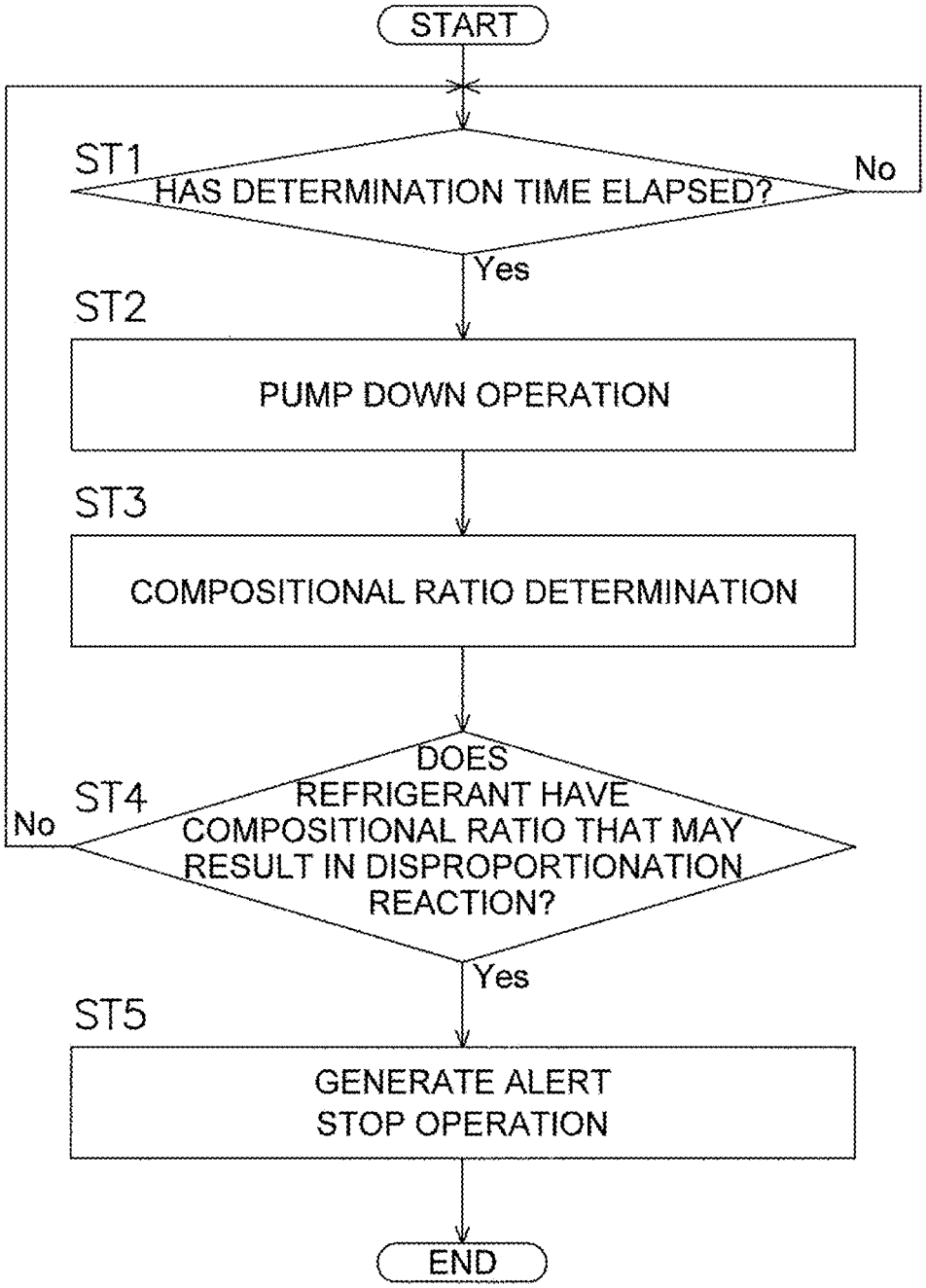
FIG. 3 is a flow chart showing pump down operation and compositional ratio determination.
Figure 4:
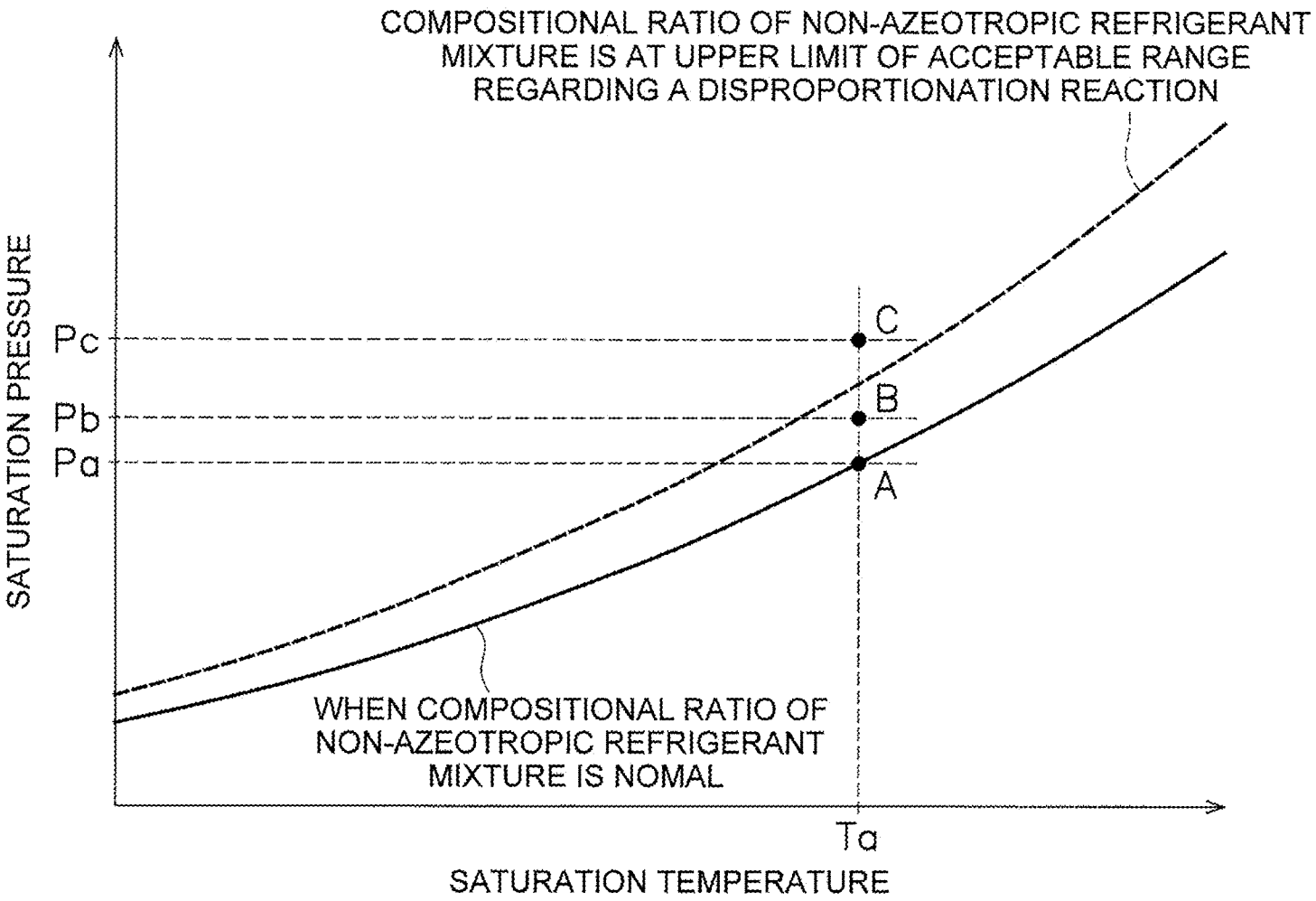
FIG. 4 is a graph showing the relationship between the saturation temperature and saturation pressure of a non-azeotropic refrigerant mixture containing a hydrofluorocarbon having the property of undergoing a disproportionation reaction.

Next, the pump down operation and the compositional ratio determination will be described with reference to FIGS. 1 to 4. Here, FIG. 3 is a flow chart showing the pump down operation and the compositional ratio determination. FIG. 4 is a graph showing the relationship between the saturation temperature and saturation pressure of the non-azeotropic refrigerant mixture containing the hydrofluorocarbon having the property of undergoing a disproportionation reaction. Same as with the air conditioning operation, the pump down operation and the compositional ratio determination described below are executed by the control unit 19. Also, here, an example in which the refrigerant sealed in the refrigerant circuit 10 is a two-component non-azeotropic refrigerant mixture containing a hydrofluorocarbon having the property of undergoing a disproportionation reaction as a low-boiling-point refrigerant, such as a mixture of HFO-1123 and HFC-32, will be described.

First, in step ST1, the control unit 19 determines whether a time after the last compositional ratio determination (e.g., the total time of air conditioning operation) exceeds a predetermined determination time. That is, the control unit 19 executes the pump down operation and the compositional ratio determination regularly. In the initial compositional ratio determination, the control unit 19 may determine whether the determination time has elapsed from the installation of the air conditioner 1. When the control unit 19 determines that the determination time has elapsed in step ST1, the control unit 19 proceeds to the next processing at step ST2.

Next, in step ST2, the control unit 19 executes the pump down operation. As described above, the pump down operation is an operation in which the non-azeotropic refrigerant mixture is collected into the portion of the refrigerant circuit 10 within the outdoor unit 2. The pump down operation is performed by flowing the refrigerant from the indoor units 3*a* and 3*b* to the outdoor unit 2 while stopping the flow of the refrigerant from the outdoor unit 2 to the indoor units 3*a* and 3*b*. Specifically, as in the cooling operation, the four-way switching valve 22 is switched to the heat release state (the state indicated by the solid lines in FIG. 1) so that the outdoor heat exchanger 23 functions as a radiator for the non-azeotropic refrigerant mixture. However, unlike the cooling operation, the outdoor expansion valve 25 is fully closed to stop the flow of the refrigerant from the outdoor unit 2 to the indoor units 3*a* and 3*b*. In this case, as in the cooling operation, the high-pressure gaseous non-azeotropic refrigerant mixture discharged from the compressor 21 releases heat in the outdoor heat exchanger 23, thus becoming high-pressure liquid non-azeotropic refrigerant mixture. The high-pressure liquid non-azeotropic refrigerant mixture accumulates in the outdoor heat exchanger 23 and the receiver 24 located between the discharge side of the compressor 21 and the outdoor expansion valve 25. On the other hand, the amount of non-azeotropic refrigerant mixture present in the liquid-refrigerant connection pipe 4, the indoor units 3*a* and 3*b*, and the gas-refrigerant connection pipe 5 decreases as the non-azeotropic refrigerant mixture is taken into the compressor 21, and the non-azeotropic refrigerant mixture is collected into the outdoor unit 2 (mainly the outdoor heat exchanger 23 and the receiver 24). In step ST2, when a pump down operation end condition is established, the control unit 19 ends the pump down operation and proceeds to the next processing at step ST3. Here, the pump down operation end condition may be, for example, when a predetermined period of time (a period of time after which the movement of the non-azeotropic refrigerant mixture to the outdoor unit 2 can be assumed to have been sufficiently performed) elapses from the start of the pump down operation, and/or, when the pressure or temperature of the non-azeotropic refrigerant mixture in the refrigerant circuit 10 (e.g., the pressure Pd of the refrigerant on the discharge side of the compressor 21) reaches a predetermined level. By this pump down operation, almost all of the non-azeotropic refrigerant mixture containing the hydrofluorocarbon having the property of undergoing a disproportionation reaction, which is unevenly distributed in the various portions of the refrigerant circuit 10, is collected into the outdoor unit 2 to create a state suitable for the subsequent compositional ratio determination.

Next, in steps ST3 and ST4, the control unit 19 executes the compositional ratio determination and determines whether the compositional ratio of the non-azeotropic refrigerant mixture determined by the compositional ratio determination is outside the acceptable proportion range of the hydrofluorocarbon having the property of undergoing a disproportionation reaction. The compositional ratio determination, as described above, is an operation in which the compositional ratio of the non-azeotropic refrigerant mixture is determined based on the pressure and temperature of the non-azeotropic refrigerant mixture collected into the outdoor unit 2 by the pump down operation. Specifically, as shown in FIG. 4, the relationship between the saturation temperature and saturation pressure of the non-azeotropic refrigerant mixture containing the hydrofluorocarbon having the property of undergoing a disproportionation reaction is prepared in advance in the form of a relation formula or data table of saturation pressure and saturation temperature for each compositional ratio of the non-azeotropic refrigerant mixture. FIG. 4 shows the relationship between saturation pressure and saturation temperature in a situation where the compositional ratio of the non-azeotropic refrigerant mixture is normal (solid line) and the relationship between saturation pressure and saturation temperature in a situation where the compositional ratio of the non-azeotropic refrigerant mixture is at the upper limit of the acceptable range regarding disproportionation reactions (dashed line). The compositional ratio of the non-azeotropic refrigerant mixture is determined from the pressure and temperature of the non-azeotropic refrigerant mixture collected into the outdoor unit 2. Here, the non-azeotropic refrigerant mixture is collected in a high-pressure saturated liquid state by pump down; therefore, the saturation pressure and saturation temperature of the non-azeotropic refrigerant mixture are close to the pressure Pd of the non-azeotropic refrigerant mixture on the discharge side of the compressor 21 and the temperature Tl of the non-azeotropic refrigerant mixture in the outdoor heat exchanger 23, respectively. The control unit 19 applies the pressure Pd and the temperature Tl to the relation formula or data table of the saturation temperature and saturation pressure of the non-azeotropic refrigerant mixture to determine the compositional ratio of the non-azeotropic refrigerant mixture. The control unit 19 then determines whether the compositional ratio of the non-azeotropic refrigerant mixture determined by the compositional ratio determination is outside the acceptable proportion range of the hydrofluorocarbon having the property of undergoing a disproportionation reaction. Specifically, it is determined whether the compositional ratio of the non-azeotropic refrigerant mixture determined by the compositional ratio determination exceeds the dashed line in FIG. 4 (i.e., the upper limit of the acceptable range regarding disproportionation reactions). For example, if the compositional ratio of the non-azeotropic refrigerant mixture determined by the compositional ratio determination lies at point A, which corresponds to the pressure Pa and the temperature Ta, the compositional ratio lies on the solid line (the normal compositional ratio of the non-azeotropic refrigerant mixture) in FIG. 4, indicating that the compositional ratio is normal without the leakage or poor charge of the non-azeotropic refrigerant mixture. If the compositional ratio of the non-azeotropic refrigerant mixture determined by the compositional ratio determination lies at point B, which corresponds to the pressure Pb and the temperature Ta, the compositional ratio lies between the solid line and the dashed line (the upper limit of the acceptable range regarding disproportionation reactions) in FIG. 4, indicating that, despite some leakage or poor charge of the non-azeotropic refrigerant mixture, the compositional ratio is within the acceptable range. If the compositional ratio of the non-azeotropic refrigerant mixture determined by the compositional ratio determination lies at point C, which corresponds to the pressure Pc and the temperature Ta, the compositional ratio lies above the dashed line in FIG. 4, indicating that the compositional ratio is outside the acceptable range because of the leakage or poor charge of the non-azeotropic refrigerant mixture. When the compositional ratio of the non-azeotropic refrigerant mixture determined by the compositional ratio determination is outside the acceptable proportion range of the hydrofluorocarbon having the property of undergoing a disproportionation reaction, the control unit 19 determines that the refrigerant may undergo a disproportionation reaction and proceeds to the next processing at step ST5. Otherwise, when the compositional ratio of the non-azeotropic refrigerant mixture determined by the compositional ratio determination is within the acceptable proportion range of the hydrofluorocarbon having the property of undergoing a disproportionation reaction, the control unit 19 determines that the refrigerant will not undergo a disproportionation reaction, returns to the processing at step ST1, and continues the operation (air conditioning operation) of the air conditioner 1. By this processing including the compositional ratio determination, it is checked whether the proportion of the hydrofluorocarbon having the property of undergoing a disproportionation reaction in the non-azeotropic refrigerant mixture is outside the acceptable range because of the leakage or poor charge of the non-azeotropic refrigerant mixture.

Next, in step ST5, the control unit 19 generates the alert indicating that the non-azeotropic refrigerant mixture has a compositional ratio that may result in a disproportionation reaction. The control unit 19 then stops the operation of the air conditioner 1. Here, the alert may be displayed on the air conditioner 1. If the air conditioner 1 is connected via a network to a service center or other site, the alert may be sent to the service center or other site.

<Features>

As described above, in this embodiment, the non-azeotropic refrigerant mixture is first collected into the outdoor unit 2 by the pump down operation. By this pump down operation, almost all of the non-azeotropic refrigerant mixture containing the hydrofluorocarbon having the property of undergoing a disproportionation reaction, which is unevenly distributed in the various portions of the refrigerant circuit 10, can be collected into the outdoor unit 2 to create a state suitable for the subsequent compositional ratio determination. Next, as described above, the compositional ratio determination is performed. In the compositional ratio determination, the compositional ratio of the non-azeotropic refrigerant mixture is determined based on the pressure Pd and temperature Tl of the non-azeotropic refrigerant mixture collected into the outdoor unit 2 by the pump down operation. As described above, if the compositional ratio of the non-azeotropic refrigerant mixture determined by the compositional ratio determination is outside the acceptable proportion range of the hydrofluorocarbon having the property of undergoing a disproportionation reaction, it is possible to determine that the refrigerant may undergo a disproportionation reaction, to generate the alert, and to stop the operation of the air conditioner 1. Otherwise, when the compositional ratio of the non-azeotropic refrigerant mixture determined by the compositional ratio determination is within the acceptable proportion range of the hydrofluorocarbon having the property of undergoing a disproportionation reaction, it is possible to determine that the refrigerant will not undergo a disproportionation reaction and to continue the operation of the air conditioner 1. Thus, here, it can be checked whether the proportion of the hydrofluorocarbon having the property of undergoing a disproportionation reaction in the non-azeotropic refrigerant mixture is outside the acceptable range because of the leakage or poor charge of the non-azeotropic refrigerant mixture.

Thus, here, in the air conditioner 1 including the refrigerant circuit 10 having sealed therein the non-azeotropic refrigerant mixture containing the hydrofluorocarbon having the property of undergoing a disproportionation reaction, the likelihood of the refrigerant undergoing a disproportionation reaction can be reduced even when the leakage or poor charge of the non-azeotropic refrigerant mixture occurs.

Here, as described above, the pump down operation and the compositional ratio determination are performed regularly. Thus, the reliability against disproportionation reactions can be improved.

Here, as described above, the pump down operation is an operation in which the non-azeotropic refrigerant mixture is collected into the outdoor heat exchanger 23 and the receiver 24. Therefore, it is possible to collect a large amount of non-azeotropic refrigerant mixture in a high-pressure liquid state. Thus, the accuracy of the compositional ratio determination can be improved.

Here, as described above, the compositional ratio of the non-azeotropic refrigerant mixture can be accurately determined based on the pressure Pd of the non-azeotropic refrigerant mixture on the discharge side of the compressor 21 and the temperature Tl of the non-azeotropic refrigerant mixture in the outdoor heat exchanger 23.

(4) First Modification

Although the temperature of the non-azeotropic refrigerant mixture used for the compositional ratio determination in the above embodiment is the temperature Tl of the non-azeotropic refrigerant mixture in the outdoor heat exchanger 23, the temperature of the non-azeotropic refrigerant mixture used for the compositional ratio determination is not limited thereto.

Figure 5:
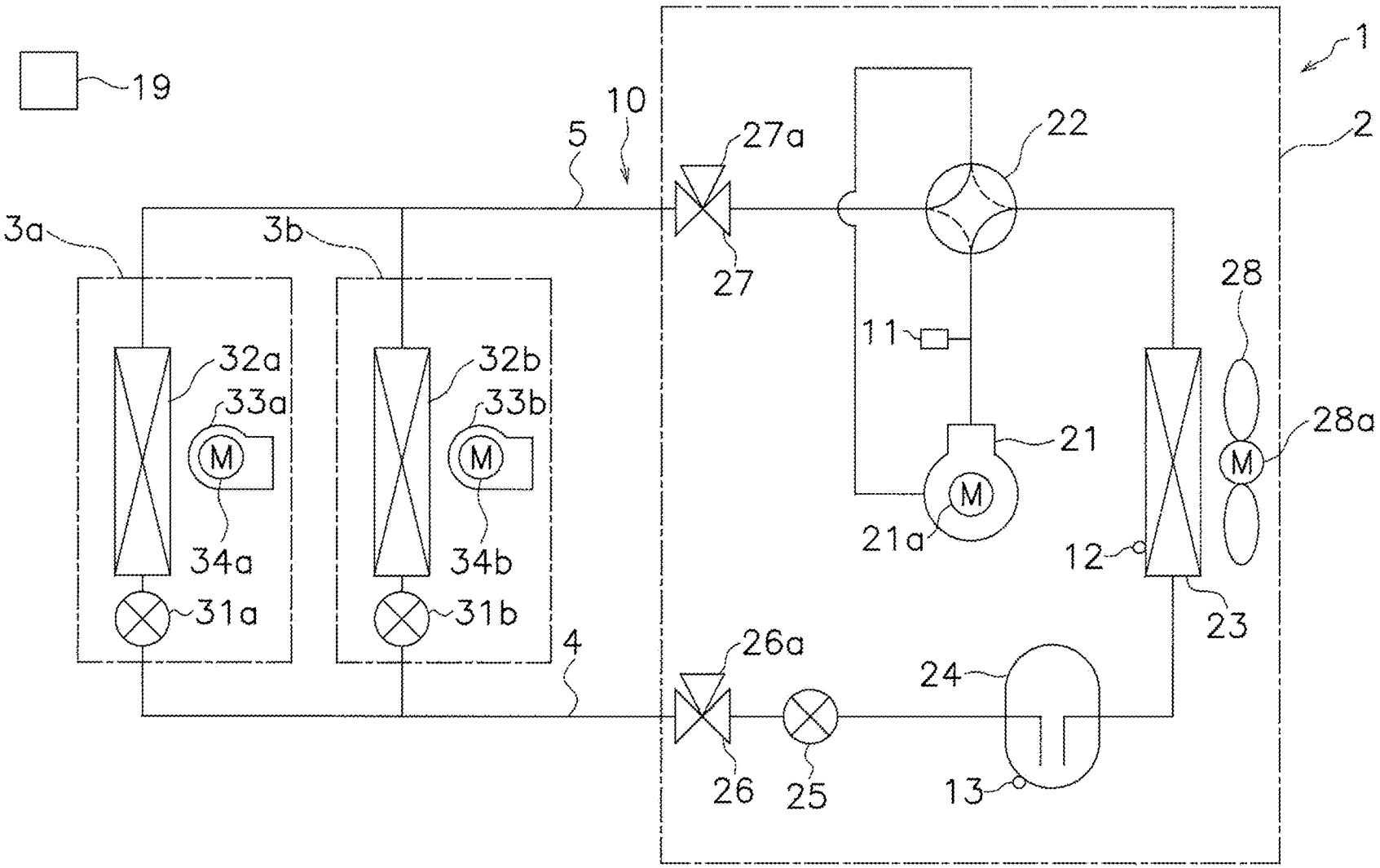
FIG. 5 is a schematic diagram of an air conditioner according to a first modification.

For example, as shown in FIG. 5, the receiver 24 may have a receiver temperature sensor 13 that detects the temperature of the non-azeotropic refrigerant mixture in the receiver 24, and the temperature Tl of the non-azeotropic refrigerant mixture detected by the receiver temperature sensor 13 may be used as a temperature of the non-azeotropic refrigerant mixture used for the compositional ratio determination.

In this case, the same operation and advantages as in the above embodiment can be achieved.

(5) Second Modification

Figure 6:
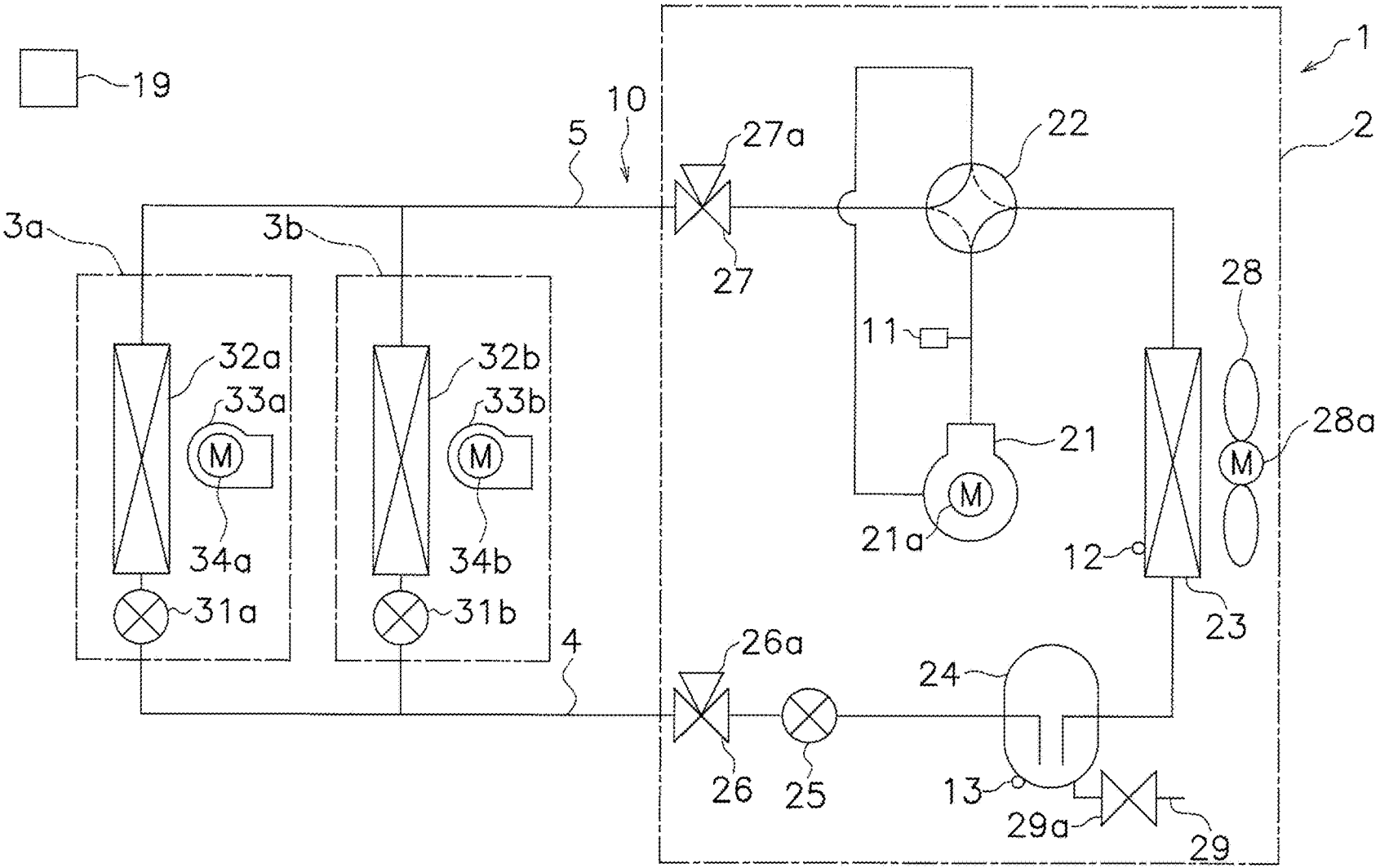
FIG. 6 is a schematic diagram of an air conditioner according to a second modification.

In the configurations of the above embodiment and the first modification (see FIGS. 1 and 5), as shown in FIG. 6, the receiver 24 may have a sampling port 29 for extracting the non-azeotropic refrigerant mixture. Here, the sampling port 29 has a sampling valve 29*a* that is manually opened and closed.

Here, as described above, the receiver 24 has the sampling port 29 for extracting the non-azeotropic refrigerant mixture. Thus, a detailed analysis of the compositional ratio of the non-azeotropic refrigerant mixture can be performed as necessary. For example, if it is determined by the compositional ratio determination that the compositional ratio of the non-azeotropic refrigerant mixture is within the acceptable range regarding disproportionation reactions but is very close to the upper limit (the dashed line in FIG. 4) of the acceptable range regarding disproportionation reactions, the non-azeotropic refrigerant mixture can be extracted from the sampling port 29 and can be subjected to a detailed compositional ratio analysis.

(6) Third Modification

In the above embodiment and the first and second modifications, it is checked by the compositional ratio determination whether the proportion of the hydrofluorocarbon having the property of undergoing a disproportionation reaction in the non-azeotropic refrigerant mixture is outside the acceptable range because of poor charge.

Here, such poor charge often occurs when the refrigerant circuit 10 is charged with the non-azeotropic refrigerant mixture in a gaseous state from a cylinder. This is because, although the cylinder contains a non-azeotropic refrigerant mixture having a normal compositional ratio, gaseous non-azeotropic refrigerant mixture containing much low-boiling-point refrigerant is present in the upper part of the cylinder. That is, if the refrigerant circuit 10 is charged with the non-azeotropic refrigerant mixture in a gaseous state from the cylinder, the refrigerant circuit 10 is charged with non-azeotropic refrigerant mixture containing much low-boiling-point refrigerant. This may result in a deviation from the normal compositional ratio. To prevent such poor charge, it is preferred to charge the refrigerant circuit 10 with the non-azeotropic refrigerant mixture in a liquid state from the cylinder.

Figure 7:
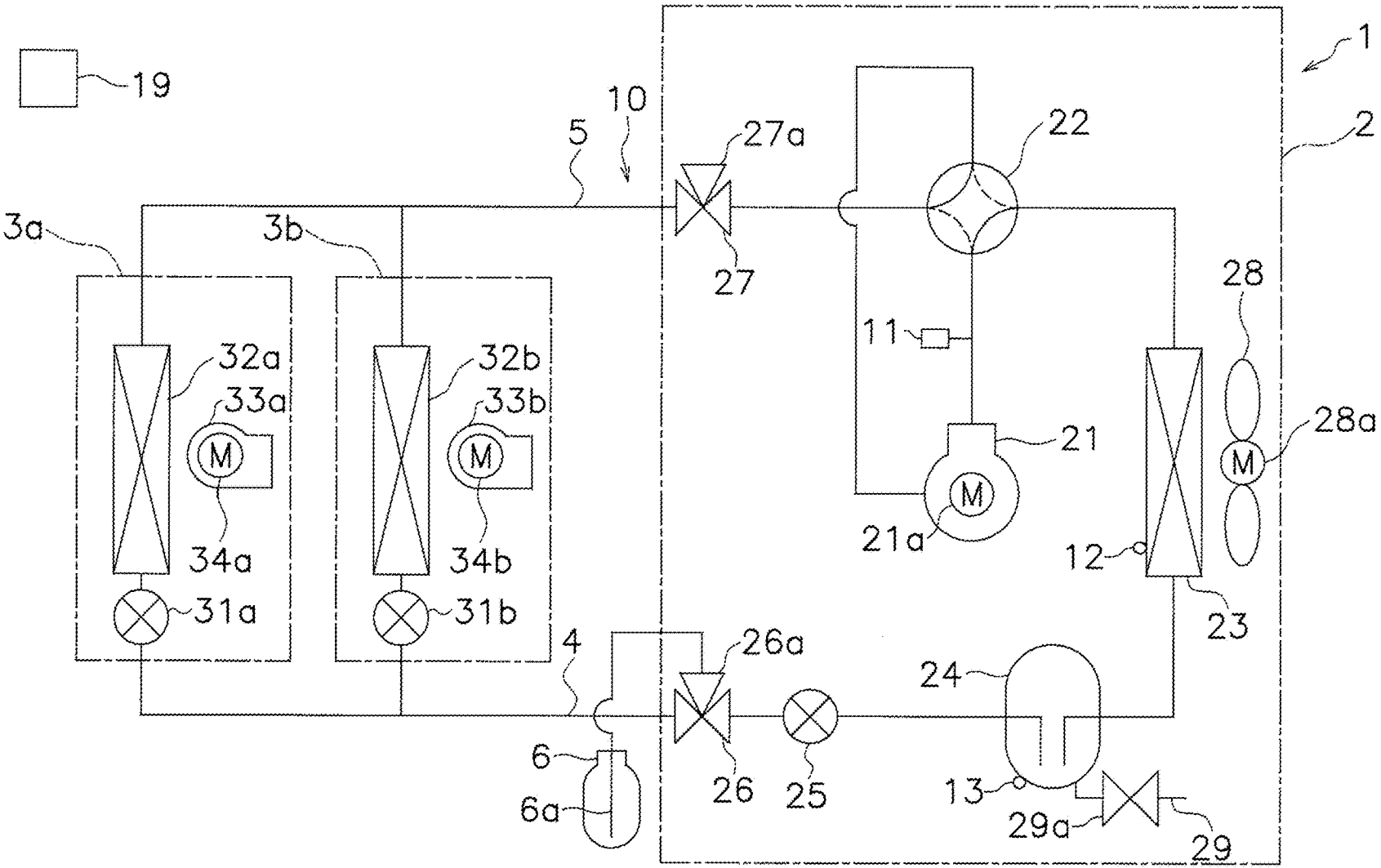
FIG. 7 is a schematic diagram of an air conditioner according to a third modification.

Accordingly, here, as shown in FIG. 7, a cylinder 6 containing a non-azeotropic refrigerant mixture having a normal compositional ratio is provided. This cylinder 6 has a siphon tube 6*a* for siphoning liquid non-azeotropic refrigerant mixture from near the bottom of the cylinder 6. The refrigerant circuit 10 is charged with the non-azeotropic refrigerant mixture through a service port of the outdoor unit 2 (in FIG. 7, through the service port 26*a*). If the cylinder 6 does not have the siphon tube 6*a*, the cylinder 6 may be placed upside down when the refrigerant circuit 10 is charged with the non-azeotropic refrigerant mixture. In this way, the refrigerant circuit 10 can be charged with a non-azeotropic refrigerant mixture having a normal compositional ratio.

Figure 8:
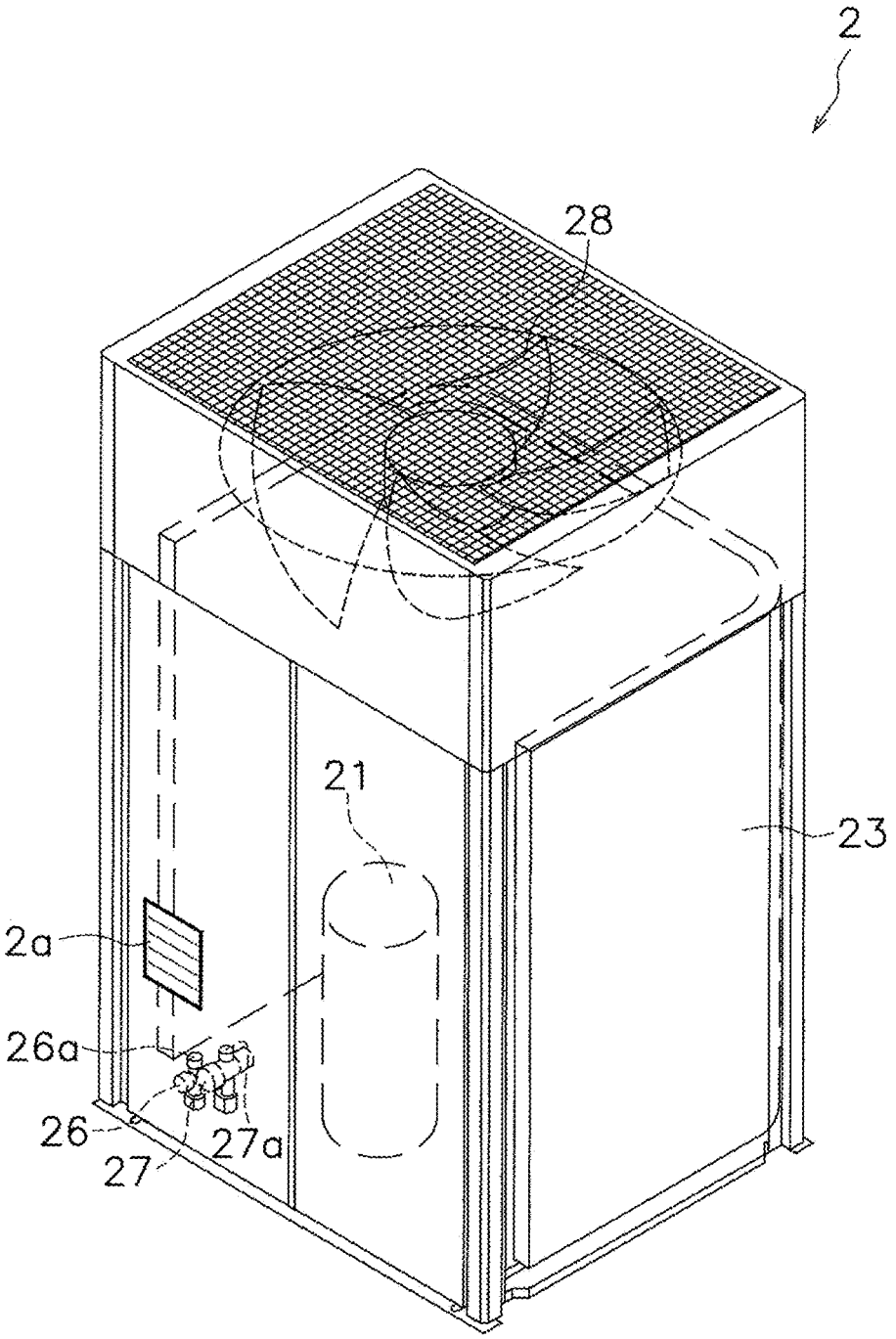
FIG. 8 is an external perspective view of an outdoor unit that constitutes the air conditioner according to the third modification.

To ensure that an operator performs the procedure of charging the refrigerant circuit 10 with the non-azeotropic refrigerant mixture in a liquid state from the cylinder 6, it is preferred that the outdoor unit 2 have a label displaying caution information stating that the non-azeotropic refrigerant mixture should not be charged in a gaseous state or that the non-azeotropic refrigerant mixture should be charged in a liquid state. For example, as shown in FIG. 8, the outdoor unit 2 has, on the outer surface thereof, a label 2*a* displaying caution information stating that the non-azeotropic refrigerant mixture should not be charged in a gaseous state or that the non-azeotropic refrigerant mixture should be charged in a liquid state. This label 2*a* is preferably disposed near the service ports 26*a* and 27*a* used for refrigerant charge to attract the attention of the operator. Although an example in which the label 2*a* is provided on the outdoor unit 2 of the type in which the outdoor fan 28 is disposed above the outdoor heat exchanger 23 has been described here, the type of outdoor unit 2 is not limited thereto; rather, the label 2*a* may be provided on another type of outdoor unit 2.

(7) Other Modifications

Although examples in which the present invention is applied to the cooling and heating switchable air conditioner 1 capable of switching between cooling operation and heating operation has been described in the above embodiment and the first to third modifications, the type of air conditioner to which the present invention can be applied is not limited thereto; rather, the present invention can also be applied to an air conditioner capable of cooling only or an air conditioner capable of simultaneous cooling and heating operation. In the above embodiment and the first to third modifications, the air conditioner 1, which is an indoor-multi-type air conditioner in which the plurality of indoor units 3*a* and 3*b* are connected to the outdoor unit 2, is used as an example, but the type is not limited thereto. The air conditioner may also be a pair-type air conditioner in which a single indoor unit is connected to the outdoor unit 2.

INDUSTRIAL APPLICABILITY

The present invention is applicable to a wide range of air conditioners including a refrigerant circuit having sealed therein a non-azeotropic refrigerant mixture containing a hydrofluorocarbon having the property of undergoing a disproportionation reaction.

REFERENCE SIGNS LIST

1 air conditioner
2 outdoor unit
3*a*, 3*b* indoor unit
10 refrigerant circuit
19 control unit
21 compressor
23 outdoor heat exchanger
24 receiver
29 sampling port

CITATION LIST

Patent Literature

PTL 1: International Publication No. 2012/157764

The invention claimed is:

1. An air conditioner comprising a refrigerant circuit including an outdoor unit and an indoor unit that are connected together and a controller that controls operation of the refrigerant circuit, and a non-azeotropic refrigerant mixture containing a hydrofluorocarbon having a property of undergoing a disproportionation reaction being sealed in the refrigerant circuit;

wherein the controller executes pump down operation in which substantially all of the non-azeotropic refrigerant mixture that is unevenly distributed throughout the refrigerant circuit is collected into a portion of the refrigerant circuit within the outdoor unit, after the completion of the pump down operation, executes compositional ratio determination in which a compositional ratio of the non-azeotropic refrigerant mixture is determined based on a pressure and temperature of the non-azeotropic refrigerant mixture collected into the outdoor unit by the pump down operation, and generates an alert when the compositional ratio of the non-azeotropic refrigerant mixture determined by the compositional ratio determination is outside an acceptable proportion range of the hydrofluorocarbon having the property of undergoing a disproportionation reaction.

2. The air conditioner according to claim 1, wherein the controller executes the pump down operation and the compositional ratio determination regularly.

3. The air conditioner according to claim 1, wherein the outdoor unit includes a compressor an outdoor heat exchanger, and a receiver, and in the pump down operation, the non-azeotropic refrigerant mixture is collected into the outdoor heat exchanger and the receiver.

4. The air conditioner according to claim 3, wherein in the compositional ratio determination, the compositional ratio of the non-azeotropic refrigerant mixture is determined based on a pressure of the non-azeotropic refrigerant mixture on a discharge side of the compressor and a temperature of the non-azeotropic refrigerant mixture in the outdoor heat exchanger or the receiver.

5. The air conditioner according to claim 3, wherein the receiver has a sampling port for extracting the non-azeotropic refrigerant mixture.

6. The air conditioner according to claim 1, wherein the non-azeotropic refrigerant mixture contains HFO-1123.

7. The air conditioner according to claim 1, wherein the controller stops operation of the air conditioner when the determined compositional ratio of the non-azeotropic refrigerant mixture is outside the acceptable proportion range of the hydrofluorocarbon having the property of undergoing the disproportionation reaction.

* * * * *